US009269290B2

(12) United States Patent
Chae et al.

(10) Patent No.: US 9,269,290 B2
(45) Date of Patent: Feb. 23, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventors: Min-Yup Chae, Cheonan-si (KR); Hoi Sik Moon, Asan-si (KR); Gwang Ho Nam, Asan-si (KR); Chang-Soo Lee, Suwon-si (KR); Jae-Seok Choi, Uijeongbu-si (KR); Hak-Mo Choi, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 34 days.

(21) Appl. No.: 14/329,233

(22) Filed: Jul. 11, 2014

(65) Prior Publication Data

US 2015/0206472 A1 Jul. 23, 2015

(30) Foreign Application Priority Data

Jan. 20, 2014 (KR) ..... 10-2014-0006906

(51) Int. Cl.
*G09G 3/36* (2006.01)
*G09G 3/20* (2006.01)

(52) U.S. Cl.
CPC ..... *G09G 3/2007* (2013.01); *G09G 3/3696* (2013.01); *G09G 2320/0247* (2013.01)

(58) Field of Classification Search
CPC . G09G 3/2007; G09G 3/3696; G09G 3/3648; G09G 3/2011
See application file for complete search history.

(56) References Cited

U.S. PATENT DOCUMENTS

| | | | | |
|---|---|---|---|---|
| 7,221,347 | B2 | 5/2007 | Lee et al. | |
| 7,289,161 | B2 | 10/2007 | Yamakawa et al. | |
| 7,468,716 | B2 | 12/2008 | Lee et al. | |
| 7,768,491 | B2 | 8/2010 | Han | |
| 8,274,461 | B2 | 9/2012 | Ha et al. | |
| 8,279,152 | B2 | 10/2012 | Murai | |
| 8,547,310 | B2 | 10/2013 | Kim | |
| 2004/0012551 | A1 | 1/2004 | Ishii | |
| 2006/0284897 | A1 * | 12/2006 | Shen | G09G 3/3611 345/690 |
| 2007/0290964 | A1 * | 12/2007 | Yang | G09G 3/3648 345/87 |
| 2009/0085896 | A1 * | 4/2009 | Nagase | H04N 19/147 345/204 |
| 2009/0289968 | A1 * | 11/2009 | Yoshida | G09G 3/2025 345/691 |
| 2009/0309903 | A1 * | 12/2009 | Park | G09G 3/3611 345/690 |
| 2012/0154345 | A1 | 6/2012 | Kim | |

FOREIGN PATENT DOCUMENTS

| | | |
|---|---|---|
| JP | 2010113240 | 5/2010 |
| KR | 1020090053602 | 5/2009 |

* cited by examiner

*Primary Examiner* — Kevin M Nguyen
(74) *Attorney, Agent, or Firm* — F. Chau & Associates, LLC

(57) ABSTRACT

A display device is provided. The display device includes pixels, a data driver, a signal controller, a data processor. The data driver is configured to apply a first data voltage to a first pixel. The signal controller is configured to transfer an image data signal and a data control signal for controlling an operation of the data driver. The data processor is configured to detect a first region including a moving in a first image signal, to apply a first dynamic capacitance control (DCC) to the first region, to apply a second DCC to a second region other than the moving pattern region, to generate the second image signal by combining the first region to which the first DCC is applied and the second region to which the second DCC is applied, and to transfer the second image signal to the signal controller.

21 Claims, 12 Drawing Sheets

Detection blocks of (k-1)-th frame

Detection blocks of k-th frame

DISPLAY DEVICE AND DRIVING METHOD THEREOF

CROSS-REFERENCE TO RELATED APPLICATION

This application claims priority under 35 U.S.C. §119 to Korean Patent Application No. 10-2014-0006906 filed on Jan. 20, 2014 in the Korean Intellectual Property Office, the disclosure of which is incorporated by reference herein in its entirety.

TECHNICAL FIELD

The present invention relates to a display device, and more particularly, to a display device and a driving method thereof.

DISCUSSION OF THE RELATED ART

A liquid crystal display (LCD) generally includes two display panels and a liquid crystal layer interposed interbetween The liquid crystal display generates an electric field in the liquid crystal layer by applying a DC voltage to the two electrodes, and obtains a desired image by adjusting the transmittance of light passing through the liquid crystal layer by adjusting the intensity of the electric field. The liquid crystal display may have a response time required to increase or decrease luminance thereof according to a change of a gray value of a received image signal. The response time includes a rising time and a falling time. The rising time is a time required to increase the luminance when a gray value to be displayed is increased from a previous frame to a current frame. The falling time is a time required to decrease the luminance when a gray value to be displayed is decreased from the previous frame to the current frame. The rising time and the falling time may be asymmetric depending on a type of the liquid crystal in the liquid crystal display. Asymmetry between the rising time and the falling time may cause a flicker effect when a motion picture is displayed in the liquid crystal display.

SUMMARY

According to an exemplary embodiment of the present invention, a display device is provided. The display device includes a plurality of pixels, a data driver, a signal controller, and a data processor. The data driver is configured to apply a first data voltage to a first data line of a plurality of data lines. The first data line is connected to a first pixel of the plurality of pixels. The signal controller is configured to transfer an image data signal and a data control signal for controlling an operation of the data driver. The image data signal includes a first image signal and a second image signal. The data processor is configured to detect a first region including a moving pattern in the first image signal, to apply a first dynamic capacitance control (DCC) to the first region, to apply a second DCC to a second region other than the moving pattern region, to generate the second image signal by combining the first region to which the first DCC is applied and the second region to which the second DCC is applied, and to transfer the second image signal to the signal controller. During a first time period, the first data voltage is higher than a reference data voltage corresponding to a first luminance to be displayed by a first predetermined level, or during a second time period, the first data voltage is lower than the reference voltage by a second predetermined level. A rising time and a falling time of luminance of the first pixel are the same as each other when the first DCC is applied, and the rising time and the falling time of the luminance of the first pixel are not controlled when the second DCC is applied.

The data processor may include a frame memory, a moving pattern detector, a first DCC unit, and a second DCC unit. The frame memory may be configured to store the first image signal in a frame unit. The moving pattern detector may be configured to divide an image signal of a current frame into a plurality of current detection blocks. The moving pattern detector may be configured to divide an image signal of a previous frame stored in the frame memory into a plurality of previous detection blocks, to detect a detection block including the moving pattern among the plurality of current detection blocks, and to transfer the plurality of current detection blocks to the first DCC unit or the second DCC unit. The first DCC unit may be configured to perform the first DCC on the plurality of current detection blocks transferred from the moving pattern detector. The second DCC unit may be configured to perform the second DCC on the plurality of current detection blocks transferred from the moving pattern detector.

The data processor may further include a data buffer. The data buffer may be configured to hold the first image signal in the frame unit and to transfer the held first image signal to the frame memory and the moving pattern detector.

The plurality of current detection blocks and the plurality of previous detection blocks may have the same size.

The moving pattern detector may be configured to determine whether a first difference between an average luminance of the plurality of current detection blocks and an average luminance of the plurality of previous detection blocks is smaller than a first reference value, and to transfer the plurality of current detection blocks to the second DCC unit when the first difference is larger than or equal to the first reference value.

The moving pattern detector may be configured to determine whether a second difference between luminance of each pixel in the plurality of current detection blocks and luminance of each pixel in the plurality of previous detection blocks is larger than a second reference value when the first difference is smaller than the first reference value.

The moving pattern detector may be configured to transfer the plurality of current detection blocks to the second DCC unit when the second difference is smaller than or equal to the second reference value.

The moving pattern detector may be configured to transfer the plurality of second detection blocks to the first DCC unit when the second difference is larger than the second reference value.

Each of the plurality of pixels may include a pixel electrode, a common electrode, and a liquid crystal layer. A data voltage may be applied to the pixel electrode. A common voltage may be applied to the common electrode. The liquid crystal layer may be provided between the pixel electrode and the common electrode.

The rising time may be a time required to increase the luminance of the first pixel from 10% to 90% of an amount of the increased luminance.

After the first time period of the rising time, the first data voltage may be changed to the reference data voltage when the luminance of the first pixel is substantially equal to the first luminance to be displayed.

The falling time may be a time required to decrease the luminance of the first pixel from 90% to 10% of an amount of the decreased luminance.

After the second time period of the falling time, the first data voltage may be changed to the reference voltage when the luminance of the first pixel is substantially equal to the first luminance to be displayed.

According to an exemplary embodiment of the present invention, a driving method of a display device is provided. The driving method includes receiving first frame data, receiving second frame data after the first frame data have been received, dividing the received first frame data into a plurality of first detection blocks, dividing the second frame data into a plurality of second detection blocks, detecting a detection block including a moving pattern among the plurality of second detection blocks, applying a first DCC to the detection block including the moving pattern, and applying a second DCC to a detection block from among the plurality of second detection blocks in which the moving pattern is not included. A first data voltage applied to a first pixel in the display device is higher than a reference voltage corresponding to a first luminance to be displayed by a first predetermined level, or lower than the reference voltage by a second predetermined level. A rising time and a falling time of luminance of the first pixel are the same as each other when the first DCC is applied, and the rising time and the falling time of the luminance of the first pixel are not controlled when the second DCC is applied.

The driving method of the display device may further include storing the first frame data in a frame unit.

The plurality of first detection blocks and the plurality of second detection blocks may have the same size.

The detecting of the detection block including the moving pattern among the plurality of second detection blocks may include determining whether a first difference between an average luminance of the plurality of second detection blocks and an average luminance of the plurality of first detection blocks is smaller than a first reference value, and applying the second DCC to the plurality of second detection blocks when the first difference is larger than or equal to the first reference value.

The detecting of the detection block including the moving pattern among the plurality of detection blocks may further include determining whether a second difference between luminance of each pixel in the plurality of second detection blocks and luminance of each pixel in the plurality of first detection blocks is larger than a second reference value.

The detecting of the detection block including the moving pattern among the plurality of detection blocks may further include applying the second DCC when the second difference is equal to or smaller than the second reference value.

The detecting of the detection block including the moving pattern among the plurality of detection blocks may further include applying the first DCC when the second difference is larger than the second reference value.

According to an exemplary embodiment of the present invention, a data processor in a display device is provided. The data processor includes a frame memory, a moving pattern detector, a first DCC unit, a second DCC unit, and a data output section. The data processor is configured to store a first image signal in a frame unit. The moving pattern detector is configured to divide an image signal of a current frame into a plurality of current detection blocks, to divide an image signal of a previous frame stored in the frame memory into a plurality of previous detection blocks, to detect a detection block including a moving among the plurality of current detection blocks, and to transfer the plurality of current detection blocks to the first DCC unit or the second DCC unit depending on whether the plurality of current detection blocks includes the moving pattern. The first DCC unit is configured to perform a first DCC on the plurality of current detection blocks transferred from the moving pattern detector. The second DCC unit is configured to perform a second DCC on the plurality of current detection blocks transferred from the moving pattern detector. The data output section is configured to generate a second image signal by combining the output image signals from the first DCC unit and the second DCC unit.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF THE DRAWINGS

Figure 1:
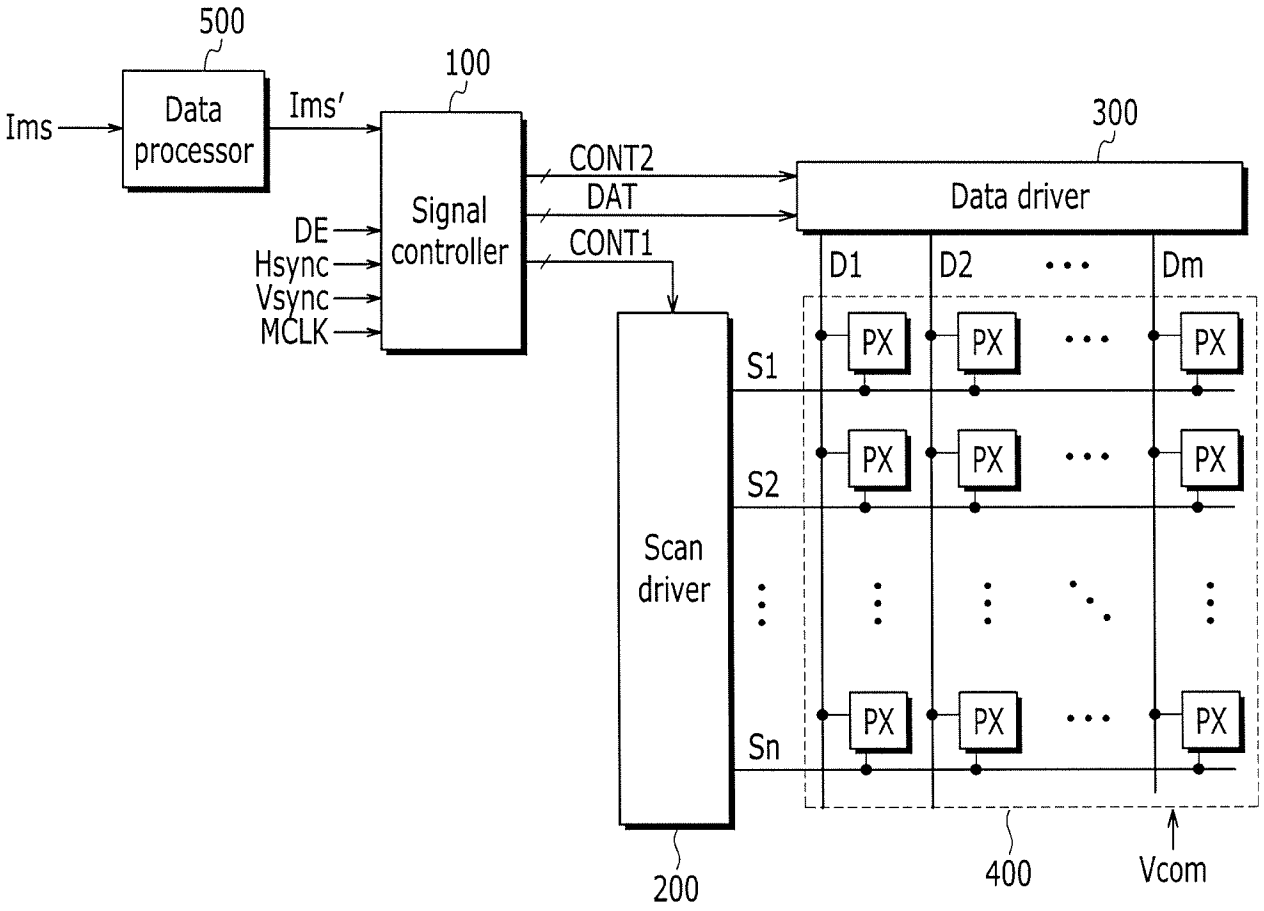
FIG. 1 is a block diagram showing a display device according to an exemplary embodiment of the present invention.

Hereinafter, exemplary embodiments of the present invention will be described in detail with reference to the accompanying drawings. The present invention may be modified in various forms, and is not limited to the exemplary embodiments disclosed herein.

In the exemplary embodiments, like reference numerals may designate the same constituent element throughout the specification and thus, description about the same constituent element may be omitted.

Figure 2:
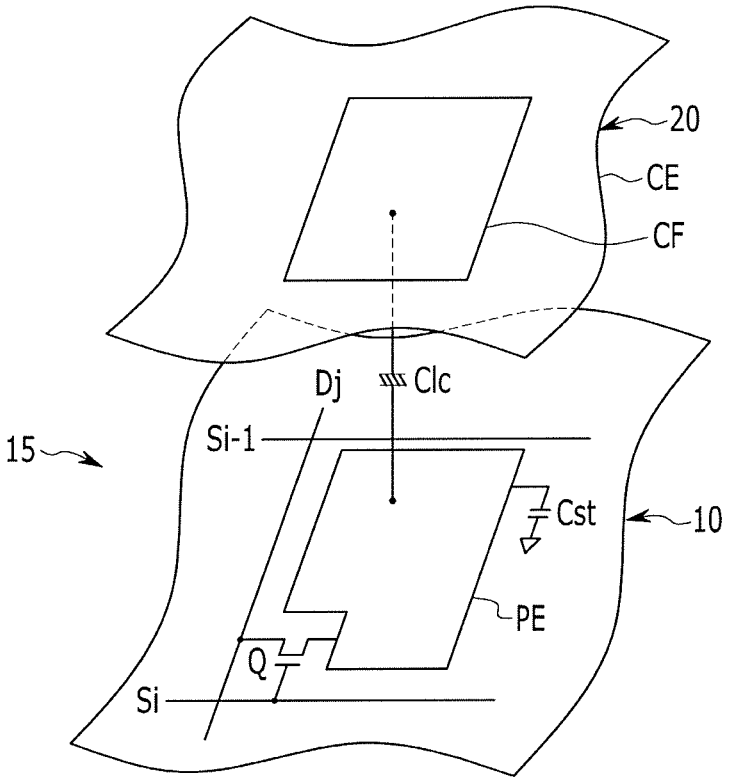
FIG. 2 is an equivalent circuit diagram for a pixel of a display device according to an exemplary embodiment of the present invention.

FIG. 1 is a block diagram showing a display device according to an exemplary embodiment of the present invention, and FIG. 2 is an equivalent circuit diagram for a pixel of a display device according to an exemplary embodiment of the present invention.

Referring to FIG. 1, a display device includes a signal controller 100, a scan driver 200, a data driver 300, a display unit 400, and a data processor 500.

The display unit 400 includes a plurality of signal lines having a plurality of scanning lines S1 to Sn and a plurality of data lines D1 to Dm, and a plurality of pixels PXs. The plurality of pixels PXs are connected to the plurality of signal lines S1 to Sn and D1 to Dm, respectively, and are arranged in a matrix form. The plurality of scanning lines S1 to Sn are substantially extended in a row direction and are substantially parallel to each other. The plurality of data lines D1 to Dm are substantially extended in a column direction and are substantially parallel to each other.

The display unit 400 may be a liquid crystal panel assembly. For example, referring to FIG. 2, the liquid crystal panel assembly includes a thin film transistor array panel 10, a common electrode panel 20 that is disposed to face the thin film transistor array panel, and a liquid crystal layer 15 that is interposed between the thin film transistor array panel 10 and the common electrode panel 20.

At least one polarizer (not shown) for polarizing light may be attached to the outside surface of the display unit 400.

Referring back to FIG. 1, the data processor 500 receives a first image signal ImS. The data processor 500 detects a moving pattern in the first image signal ImS, and applies a first dynamic capacitance control (DCC) to a region having a moving pattern (hereinafter, referred to as a "moving pattern region") and a second DCC to a region other than the moving pattern region. The data processor 500 generates a second image signal ImS' to which at least one of the first DCC and the second DCC is applied, and transfers the second image signal ImS' to the signal controller 100.

To reduce a response time of a liquid crystal in the display device, a DCC (e.g., first DCC or second DCC) generates a data voltage corresponding to a higher gray value than an original gray value to be displayed by a predetermined value or a lower gray value than the original gray value to be displayed by a predetermined value. The response time of the liquid crystal includes a rising time in which luminance rises from a low gray value to a high gray value and a falling time in which the luminance drops from the high gray value to the low gray value.

For example, when a data voltage corresponding to the low gray value is applied to a particular pixel in a previous frame and a data voltage corresponding to the high gray value is applied to the pixel in the current frame, the DCC (e.g., first DCC or second DCC) outputs a data voltage corresponding to a higher gray value than the original gray value to be displayed in the current frame to reduce the rising time of the luminance at the pixel. Further, when a data voltage of the high gray is applied to a particular pixel in a previous frame and a data voltage corresponding to the low gray is applied to the pixel in the current frame, the DCC (e.g., first DCC or second DCC) outputs a data voltage corresponding to the lower gray value than the original gray value to be displayed in the current frame to reduce the falling time of the luminance at the pixel.

Although the data processor 500 and the signal controller 100 may be separately provided, as shown in FIG. 1, the present invention is not limited thereto. For example, the data processor 500 may be included in the signal controller 100.

The signal controller 100 receives the second image signal ImS' and an input control signal for controlling the display of the second image signal ImS'. The input control signal includes a data enable signal DE, a horizontal synchronizing signal Hsync, a vertical synchronization signal Vsync, and a main clock signal MCLK.

The signal controller 100 transfers an image data signal DAT and a data control signal CONT2 to the data driver 300. The data control signal CONT2, which is a signal for controlling an operation of the data driver 300, may include a horizontal synchronization start signal STH for indicating a transmission start of the image data signal DAT, a load signal LOAD for directing an output of a gray voltage to the data lines D1 to Dm, and a data clock signal HCLK. The data control signal CONT2 may further include an inversion signal RVS for inverting a polarity in voltage of the image data signal DAT with respect to the common voltage Vcom.

The signal controller 100 transfers a scan control signal CONT1 to the scan driver 200. The scan control signal CONT1, which is a signal for controlling an operation of the scan driver 200, may include a scanning start signal STV of the scan driver 200 and at least one clock signal CKV for controlling an output of a gate-on voltage. The scan control signal CONT1 may further include an output enable signal OE for controlling a duration time of the gate-on voltage.

The data driver 300 is connected to a plurality of data lines D1 to Dm disposed at the display unit 400 and selects the gray voltage corresponding to the image data signal DAT. For example, the data driver 300 may generate the gray voltages with respect to the entire grayscale by dividing a predetermined number of reference gray voltages, and the data driver 300 may select a gray voltage corresponding to the image data signal DAT from among them. The data driver 300 applies the selected gray voltage to the data lines D1 to Dm as the data voltage.

The scan driver 200 is connected to the plurality of scanning lines S1 to Sn disposed at the display unit 400 and applies scanning signals to the plurality of scanning lines S1 to Sn. The scanning signals are generated by using the gate-on voltage that turns on a switching element (see, e.g., Q of FIG. 2) and a gate-off voltage that turns off the switching element. The scan driver 200 may sequentially apply the scanning signals of the gate-on voltage to the plurality of scanning lines S1 to Sn.

Each of the signal controller 100, the scan driver 200, the data driver 300, and the data processor 500 may be directly mounted on the display unit 400 in at least one IC chip form, may be mounted on a flexible printed circuit (FPC) film to be attached to the display unit 400 in a tape carrier package (TCP) form, or may be mounted on a separate printed circuit board (PCB). In addition, the signal controller 100, the scan driver 200, the data driver 300, and the data processor 500 may be integrated in the display unit 400 together with the plurality of scanning lines S1 to Sn and the plurality of data lines D1 to Dm.

Hereinafter, a single pixel PX of the display unit 400 will be described. Referring back to FIG. 2, the pixel PX that is connected to an i-th scanning line Si and a j-th data line Dj will be described as an example. Here, $1<i\leq n$ and $1\leq j\leq m$. The pixel PX includes a switching element Q, a liquid crystal capacitor Clc, and a storage capacitor Cst connected thereto.

The switching element Q is a three-terminal element such as a thin film transistor or the like provided to a thin film transistor array panel 10. The switching element Q includes a gate terminal connected to a corresponding one of the scanning lines S1 to Sn, an input terminal connected to a corresponding one of the data lines D1 to Dm, and an output terminal connected to the liquid crystal capacitor Clc and the storage capacitor Cst. The thin film transistor includes amorphous silicon or polysilicon.

The thin film transistor may be an oxide thin film transistor (oxide TFT) in which a semiconductor layer is made of an oxide semiconductor.

The oxide semiconductor may include an oxide such as a titanium (Ti), hafnium (Hf), zirconium (Zr), aluminum (Al), tantalum (Ta), germanium (Ge), zinc (Zn), gallium (Ga), tin (Sn), indium (In), or the like, or a composite oxide such as zinc oxide (ZnO), indium-gallium-zinc oxide ($InGaZnO_4$), indium-zinc oxide (In—Zn—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), hafnium-indium-zinc oxide (Hf—In—Zn—O), or the like.

The semiconductor layer includes a channel region in which an impurity is not doped, and source and drain regions which are formed by doping the impurity at both sides of the channel region. Here, the impurity is changed according to a type of the thin film transistor. For example, an N-type impurity or a-P type impurity may exist.

When the semiconductor layer is made of the oxide semiconductor, a separate protective layer may be added to protect the oxide semiconductor from being exposed to the external environment such as high temperature.

The liquid crystal capacitor Clc includes a pixel electrode PE of the thin film transistor array panel 10 and a common electrode CE of the common electrode panel 20 as two terminals, and the liquid crystal layer 15 interposed between the pixel electrode PE and the common electrode CE functions as a dielectric material. The liquid crystal layer 15 has dielectric anisotropy. A pixel voltage is formed by a difference in voltage between the pixel electrode PE and the common electrode CE.

The pixel electrode PE is connected to the switching element Q. The common electrode CE is formed over the entire surface of the common electrode panel 20 to receive the common voltage Vcom. Unlike FIG. 2, the common electrode CE may be provided in the thin film transistor array panel 10, and in this case, at least one of the two electrodes PE and CE may be formed in a linear or rod form.

The storage capacitor Cst, which is an auxiliary capacitor for the liquid crystal capacitor Clc, may be formed by the pixel electrode PE and a separate signal line (not shown) facing the pixel electrode PE via an insulator. The separate signal line is provided on the thin film transistor array panel 10. and is supplied with a predetermined voltage such as the common voltage Vcom.

A color filter CF may be formed in a partial region of the common electrode CE on the common electrode panel 20. For example, each pixel PX may uniquely display a primary color (e.g., red, green, blue), and may form a desired color by a spatial combination of the primary colors. In addition, each pixel PX may alternately display the primary colors according to time, and may form a desired color by a temporal combination of the primary colors.

As an example of the spatial division, each pixel PX includes the color filter CF that displays one of the primary colors and is formed in a partial region of the common electrode panel 20 corresponding to the pixel electrode PE. However, the color filter CF may be formed on an upper or lower surface of the pixel electrode PE of the thin film transistor array panel 10.

Figure 3:
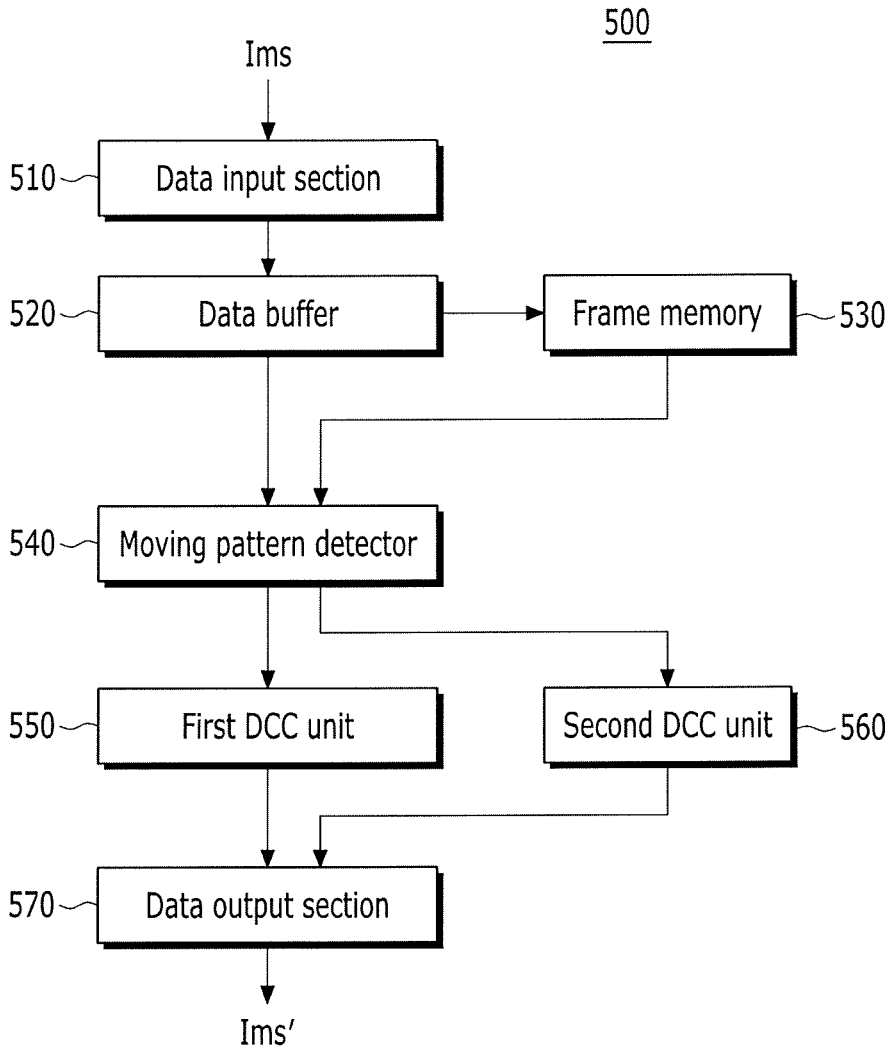
FIG. 3 is a block diagram showing a data processor according to an exemplary embodiment of the present invention.

FIG. 3 is a block diagram showing the data processor 500 according to an exemplary embodiment of the present invention.

Referring to FIG. 3, the data processor 500 includes a data input section 510, a data buffer 520, a frame memory 530, a moving pattern detector 540, a first DCC unit 550, a second DCC unit 560, and a data output section 570.

The data input section 510 receives a first image signal ImS from the outside. The data input section 510 transfers the first image signal ImS to the data buffer 520.

The data buffer 520 holds the first image signal ImS, and transfers the held first image signal ImS to the frame memory 530 and the moving pattern detector 540. Here, the data buffer 520 may hold the first image signal ImS in a frame unit, and may transfer the first image signal ImS held in the frame unit to the frame memory 530 and the moving pattern detector 540.

The frame memory 530 stores the first image signal ImS transferred from the data buffer 520 in the frame unit. When the moving pattern detector 540 detects a moving pattern in a current frame, the frame memory 530 transfers an image signal of the previous frame, which is stored therein, to the moving pattern detector 540. For example, the image signal of the previous frame may be stored in the frame memory 530.

The moving pattern detector 540 detects the moving pattern by using the image signal (e.g., first image signal ImS) of the current frame transferred from the data buffer 520 with the image signal of the previous frame transferred from the frame memory 530. The moving pattern is a specific pattern that moves with time in the motion picture.

A method for detecting the moving pattern will be described with reference to FIGS. 4 and 5.

Figure 4:
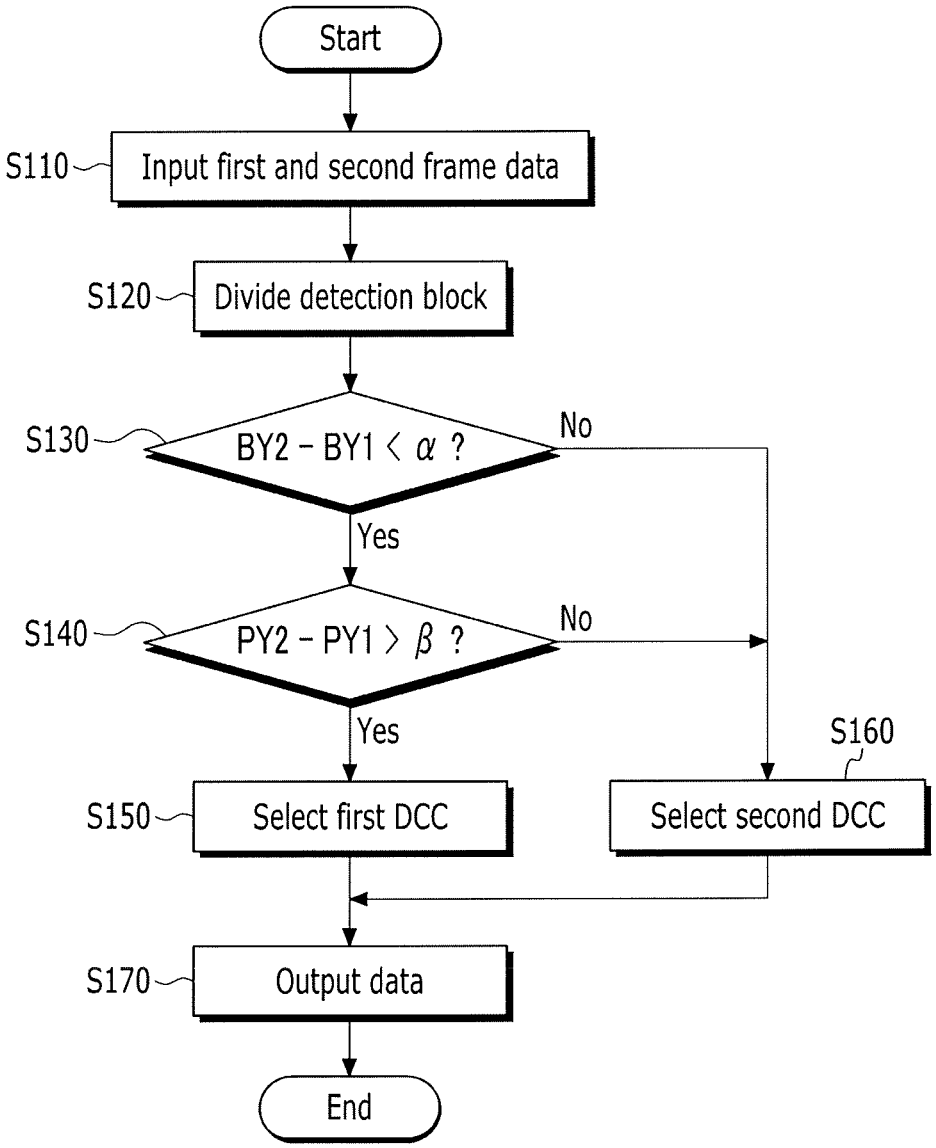
FIG. 4 is a flowchart showing an operation process of a moving pattern detector according to an exemplary embodiment of the present invention.

FIG. 4 is a flowchart showing an operation process of a moving pattern detector according to an exemplary embodiment of the present invention. FIG. 5 is a diagram for illustrating a method for detecting a moving pattern in a moving pattern detector according to an exemplary embodiment of the present invention.

Figure 5:
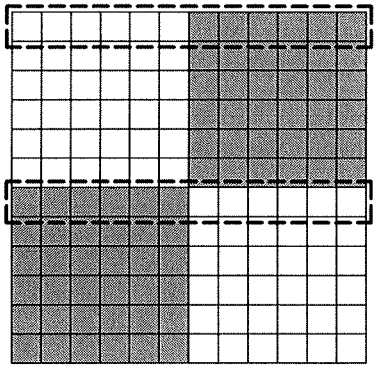
FIG. 5 is a diagram for illustrating a method for detecting a moving pattern in a moving pattern detector according to an exemplary embodiment of the present invention.
Figure 5:
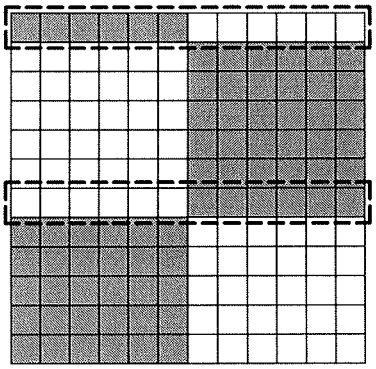

Referring to FIGS. 4 and 5, first and second frame data are input to the moving pattern detector 540 (S110). For example, the first frame data is the image signal of the previous frame, and the second frame data is the image signal of the current frame.

The moving pattern detector 540 divides each of the first frame data (e.g., an image signal of a previous frame) and the second frame data (e.g., an image signal of a current frame) into a plurality of detection blocks (S120). For example, an image of a single frame displayed by the first frame data may be divided into a plurality of first detection blocks. Further, an image of a single frame displayed by the second frame data may be divided into a plurality of second detection blocks.

The plurality of first detection blocks of the first frame data and the plurality of second detection blocks of the second frame data have the same size. For example, as shown in FIG. 5, a plurality of detection blocks of a (k−1)-th frame (e.g., previous frame) and a plurality of detection blocks of a k-th frame (e.g., current frame) may have the same size of 12×12. The size of the detection blocks is not limited thereto, but may be changed in various sizes.

The moving pattern detector 540 determines whether a first difference between an average luminance BY2 of the plurality of second detection blocks of the current frame and an average luminance BY1 of the plurality of first detection blocks of the previous frame is smaller than a first reference value α (S130). The first difference between the average luminance BY2 of the plurality of second detection blocks and the average luminance BY1 of the plurality of first detection blocks may be calculated as an absolute value. The first reference value α is a reference value for determining a difference (e.g., first difference) in average luminance of the detection blocks between the frames.

The moving pattern detector 540 selects the second DCC when the first difference between the average luminance BY2 of the plurality of second detection blocks of the current frame and the average luminance BY1 of the plurality of first detection blocks of the previous frame is larger than or equal to the first reference value α (S160). The second DCC is a DCC that is applied to the region other than the moving pattern region.

When the first difference between the average luminance BY2 of the plurality of second detection blocks of the current frame and the average luminance BY1 of the plurality of first detection blocks of the previous frame is smaller than the first reference value α, the moving pattern detector 540 determines whether a second difference between luminance PY2 of each pixel included in the plurality of second detection blocks and luminance PY1 of each pixel included in the plurality of first detection blocks is larger than a second reference value β (S140). The second difference between the luminance PY2 of each pixel included in the plurality of second detection blocks and the luminance PY1 of each pixel included in the plurality of first detection blocks may be calculated as an absolute value. The second reference value β is a reference value for determining a difference (e.g., second difference) in luminance of each pixel included in the plurality of detection blocks between the frames.

The moving pattern detector 540 selects the second DCC when the second difference between the luminance PY2 of each pixel included in plurality of the second detection blocks and the luminance PY1 of each pixel included in the plurality of first detection blocks is smaller than or equal to the second reference value β (S160).

The moving pattern detector 540 selects the first DCC when the second difference between the luminance PY2 of each pixel included in the plurality of second detection blocks and the luminance PY1 of each pixel included in the plurality of first detection blocks is larger than the second reference value β (S150). The first DCC is a DCC that is applied to the moving pattern region. For example, when the first difference between the average luminance BY2 of the plurality of second detection blocks and the average luminance BY1 of the plurality of first detection blocks is smaller than the first reference value α and the second difference between the luminance PY2 of each pixel included in the plurality of second detection blocks and the luminance PY1 of each pixel included in the plurality of first detection blocks is larger than the second reference value β, the plurality of second detection blocks is determined to include the moving pattern.

When the first DCC is selected, the moving pattern detector 540 outputs the plurality of second detection blocks of the current frame to the first DCC unit 550, and when the second DCD is selected, the moving pattern detector 540 outputs the plurality of second detection blocks of the current frame to the second DCC unit 560 (S170).

FIG. 5 shows a case in which a plurality of detection blocks has a size of 12×12 and a lattice pattern having a size of 6×6 moves at a speed of one pixel per frame in a downward direction.

For example, when the average luminance BY1 of the plurality of first detection blocks of the (k−1)-th frame (e.g., previous frame) and the average luminance BY2 of the plurality of second detection blocks of the k-th frame (e.g., current frame) are substantially the same as each other, the first difference between the average luminance BY2 of the plurality of second detection blocks of the k-th frame (e.g., current frame) and the luminance BY1 of the plurality of first detection blocks of the (k−1)-th frame (e.g., previous frame) may be determined to be smaller than the first reference value α.

In addition, when the second difference between the luminance PY1 of each pixel in a dotted line of the plurality of first detection blocks of the (k−1)-th frame (e.g., previous frame) and the luminance PY2 of each pixel of a dotted line of the plurality of second detection blocks of the k-th frame (e.g., current frame) is larger than the second reference value β, the corresponding second detection blocks in the dotted line of the k-th frame (e.g., current frame) may be determined to include the moving pattern.

Table 1 shows a method for detecting the moving pattern described above.

TABLE 1

| | | difference in average luminance of detection blocks between frames | |
|---|---|---|---|
| moving pattern detection | | <α | ≥α |
| difference in luminance of pixel between frames | ≤β | Non moving pattern | Non moving pattern |
| | >β | Moving pattern | Non moving pattern |

According to the above-described method, the moving pattern detector 540 determines whether a plurality of detection blocks (e.g., plurality of second detection blocks) includes the moving pattern, and transfers one detection block including the moving pattern to the first DCC unit 550 and another detection block in which the moving pattern is not included to the second DCC unit 560.

Referring back to FIG. 3, the first DCC unit 550 applies the first DCC to the detection block including the moving pattern. The first DCC is a DCC in which the rising time and falling time are the same as each other. For example, the first DCC unit 550 operates to make the rising and falling times the same as each other by using the first DCC.

The second DCC unit 560 applies the second DCC to the detection block in which the moving pattern is not included. The second DCC is a DCC in which the rising time and falling time are not considered. For example, in the second DCC, the rising time and the falling time are different from each other. For example, the second DCC unit 560 operates regardless of the rising and falling times by using the second DCC.

The data output section 570 receives the detection block to which the first DCC is applied from the first DCC unit 550 and the detection block to which the second DCC is applied from the second DCC unit 560. The data output section 570 combines the detection block to which the first DCC is applied and the detection block to which the second DCC is applied and generates a second image signal ImS' of the current frame. The data output section 570 may output the generated second image signal ImS' to the signal controller 100.

The moving pattern may be detected by comparing spatial frequencies between frames for displaying the motion picture. For example, the spatial frequencies correspond to Fourier series of a spatial periodic function of a moving pattern having a predetermined period and thus the moving pattern may be detected.

Hereinafter, a first DCC and a second DCC will be described with reference to FIGS. 6 to 8.

Figure 6:
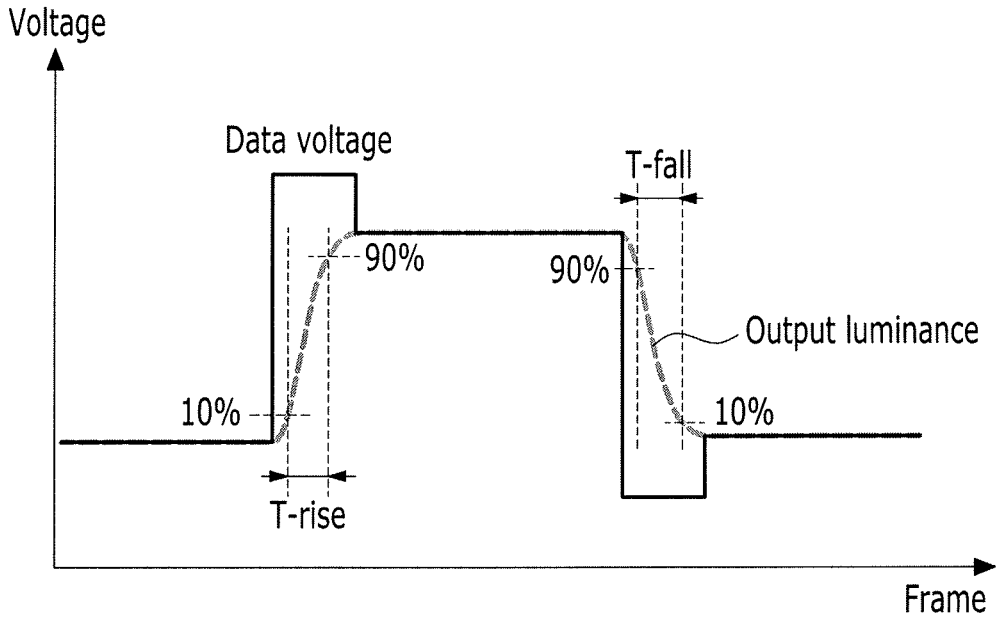
FIG. 6 is a graph showing a first dynamic capacitance control (DCC) according to an exemplary embodiment of the present invention.

FIG. 6 is a graph showing a first DCC according to an exemplary embodiment of the present invention. FIG. 7 is a graph showing a second DCC according to an exemplary embodiment of the present invention. FIG. 8 is a graph showing a second DCC according to an exemplary embodiment of the present invention.

The rising time T-rise may be a time required to increase the luminance of the pixel from 10% to 90% of an amount of the increased luminance when a data voltage with a higher gray value than that of the previous frame is applied to the pixel electrode PE. The falling time T-fall may be a time required to decrease the luminance of the pixel from 90% to 10% of an amount of the decreased luminance when a data voltage with a lower gray value than that of the previous frame is applied to the pixel electrode PE.

When the data voltage with the higher gray value than that of the previous frame is generated in the current frame, at first, an outputted data voltage (e.g., preceding data voltage) is higher than an original data voltage corresponding to a gray value to be displayed by a predetermined level, and is changed to the original data voltage corresponding to the gray value to be displayed by a predetermined level when the luminance of the pixel reaches the value corresponding to the desired gray value to be displayed. For example, since at first, the data voltage is higher than the original data voltage corresponding to the gray value to be displayed by the predetermined level, the pixel voltage may be rapidly increased and thus, the rising time T-rise of the luminance at the pixel may be reduced.

In addition, when the data voltage with the lower gray value than that of the previous frame is generated in the current frame, at first, an outputted data voltage (e.g., preceding data voltage) is lower than an original data voltage corresponding to a gray value to be displayed by a predetermined level, and the data voltage is changed to the original voltage corresponding to the gray value to be displayed by a predetermined level when the luminance of the pixel reaches the value corresponding to the desired gray value to be displayed. For example, since at first, the data voltage is lower than the original data voltage corresponding to the gray value to be displayed, the pixel voltage may be rapidly decreased and the falling time T-fall of the luminance may be reduced.

As shown in FIG. 6, the preceding data voltage may be selected so that the rising time T-rise and the falling time T-fall are substantially the same as each other, and the preceding data voltage may be applied by the first DCC.

Table 2 is an example showing the rising time T-rise and the falling time T-fall when a gray value is changed from one gray value (see, e.g., first column of Table 2) to another gray value (see, e.g., first row of Table 2) in the first DCC. A unit of the rising time T-rise and the falling time T-fall is ms.

TABLE 2

| gray | | 31 | 63 | 95 | 127 | 159 | 191 | 223 | 255 |
|---|---|---|---|---|---|---|---|---|---|
| 0 | T-rise | 2.97 | 3.41 | 4.11 | 3.21 | 4.37 | 3.97 | 4.55 | 4.66 |
| | T-fall | 2.97 | 3.41 | 4.11 | 3.21 | 4.37 | 3.97 | 4.55 | 4.66 |
| | Diff | 0 | 0 | 0 | 0 | 0 | 0 | 0 | 0 |
| 31 | T-rise | | 5.58 | 7.66 | 5.37 | 7.02 | 5.43 | 5.51 | 5.71 |
| | T-fall | | 5.58 | 7.66 | 5.37 | 7.02 | 5.43 | 5.51 | 5.71 |
| | Diff | | 0 | 0 | 0 | 0 | 0 | 0 | 0 |
| 63 | T-rise | | | 5.65 | 5.53 | 7.51 | 6.48 | 4.65 | 4.78 |
| | T-fall | | | 5.65 | 5.53 | 7.51 | 6.48 | 4.65 | 4.78 |
| | Diff | | | 0 | 0 | 0 | 0 | 0 | 0 |
| 95 | T-rise | | | | 4.32 | 7.58 | 6.82 | 8.58 | 8.59 |
| | T-fall | | | | 4.32 | 7.58 | 6.82 | 8.58 | 8.59 |
| | Diff | | | | 0 | 0 | 0 | 0 | 0 |
| 127 | T-rise | | | | | 5.31 | 8.88 | 8.73 | 8.72 |
| | T-fall | | | | | 5.31 | 8.88 | 8.73 | 8.72 |
| | Diff | | | | | 0 | 0 | 0 | 0 |
| 159 | T-rise | | | | | | 5.34 | 8.63 | 8.62 |
| | T-fall | | | | | | 5.34 | 8.63 | 8.62 |
| | Diff | | | | | | 0 | 0 | 0 |
| 191 | T-rise | | | | | | | 7.78 | 8.38 |
| | T-fall | | | | | | | 7.78 | 8.38 |
| | Diff | | | | | | | 0 | 0 |
| 223 | T-rise | | | | | | | | 0.03 |
| | T-fall | | | | | | | | 0.03 |
| | Diff | | | | | | | | 0 |

Figure 7:
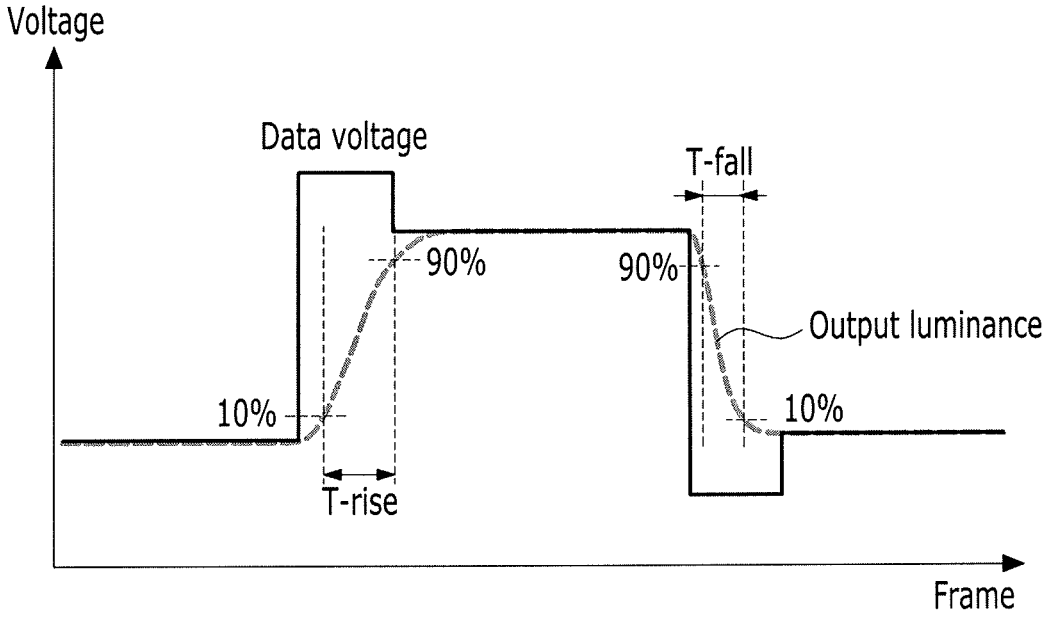
FIG. 7 is a graph showing a second DCC according to an exemplary embodiment of the present invention.

As shown in FIG. 7, the preceding data voltage may be selected regardless of the rising time T-rise and the falling time T-fall, and the preceding data voltage may be applied by the second DCC. FIG. 7 shows a case in which the rising time T-rise is longer than the falling time T-fall.

Table 3 is an example showing the rising time T-rise and the falling time T-fall when a gray value is changed from one gray value (see, e.g., first column of Table 3) to another gray value (see, e.g., first row of Table 3) in the second DCC. The unit of the rising time T-rise and the falling time T-fall is ms.

TABLE 3

| gray | | 31 | 63 | 95 | 127 | 159 | 191 | 223 | 255 |
|---|---|---|---|---|---|---|---|---|---|
| 0 | T-rise | 2.97 | 3.41 | 4.11 | 3.21 | 4.37 | 3.97 | 4.55 | 4.66 |
| | T-fall | 1.91 | 2.01 | 2.13 | 2.3 | 2.4 | 2.5 | 2.68 | 2.68 |
| | Diff | 1.06 | 1.4 | 1.96 | 0.91 | 1.97 | 1.47 | 1.87 | 1.98 |
| 31 | T-rise | | 5.58 | 7.66 | 5.37 | 7.02 | 5.43 | 5.51 | 5.71 |
| | T-fall | | 7.69 | 5.37 | 4.37 | 3.54 | 3.24 | 3.16 | 3.17 |
| | Diff | | -2.11 | 2.29 | 1 | 3.48 | 2.19 | 2.35 | 2.54 |
| 63 | T-rise | | | 5.65 | 5.53 | 7.51 | 6.48 | 4.65 | 4.78 |
| | T-fall | | | 3.89 | 3.06 | 3.02 | 2.95 | 2.97 | 2.98 |
| | Diff | | | 1.76 | 2.47 | 4.49 | 3.53 | 1.68 | 1.8 |
| 95 | T-rise | | | | 4.32 | 7.58 | 6.82 | 8.58 | 8.59 |
| | T-fall | | | | 3.07 | 3.16 | 3.27 | 3.19 | 3.21 |
| | Diff | | | | 1.25 | 4.42 | 3.55 | 5.39 | 5.38 |
| 127 | T-rise | | | | | 5.31 | 8.88 | 8.73 | 8.72 |
| | T-fall | | | | | 6.11 | 5.15 | 3.61 | 3.83 |
| | Diff | | | | | -0.8 | 3.73 | 4.92 | 4.89 |
| 159 | T-rise | | | | | | 5.34 | 8.63 | 8.62 |
| | T-fall | | | | | | 3.76 | 3.43 | 3.42 |
| | Diff | | | | | | 1.58 | 5.2 | 5.2 |
| 191 | T-rise | | | | | | | 7.78 | 8.38 |
| | T-fall | | | | | | | 2.35 | 2.31 |
| | Diff | | | | | | | 5.49 | 6.07 |
| 223 | T-rise | | | | | | | | 0.03 |
| | T-fall | | | | | | | | 0.02 |
| | Diff | | | | | | | | 0.01 |

Referring to Table 3, when a gray value is changed from one gray value to another gray value, generally, the rising time T-rises are longer than the falling times T-fall excepting for some cases (e.g., a case when the gray value is changed from 31 to 63, or from 127 to 159). Here, the maximum rising time T-rise is 8.88 ms when the gray value is changed from 127 to 191. Further, an average of difference values between the rising time T-rise and the falling time T-fall is 4.65 ms excepting for a white gray value and a black gray value.

Table 2 in which the rising time T-rise and the falling time T-fall are the same as each other is made by matching the falling time T-fall to the rising time T-rise in Table 3. The maximum rising time T-rise in Table 2 is 8.88 ms when the gray value is changed from 127 to 191, similar to Table 3. In addition, an average of difference values between the rising time T-rise and the falling time T-fall is 5.99 ms excepting for the white gray value and black gray value in Table 2.

Figure 8:
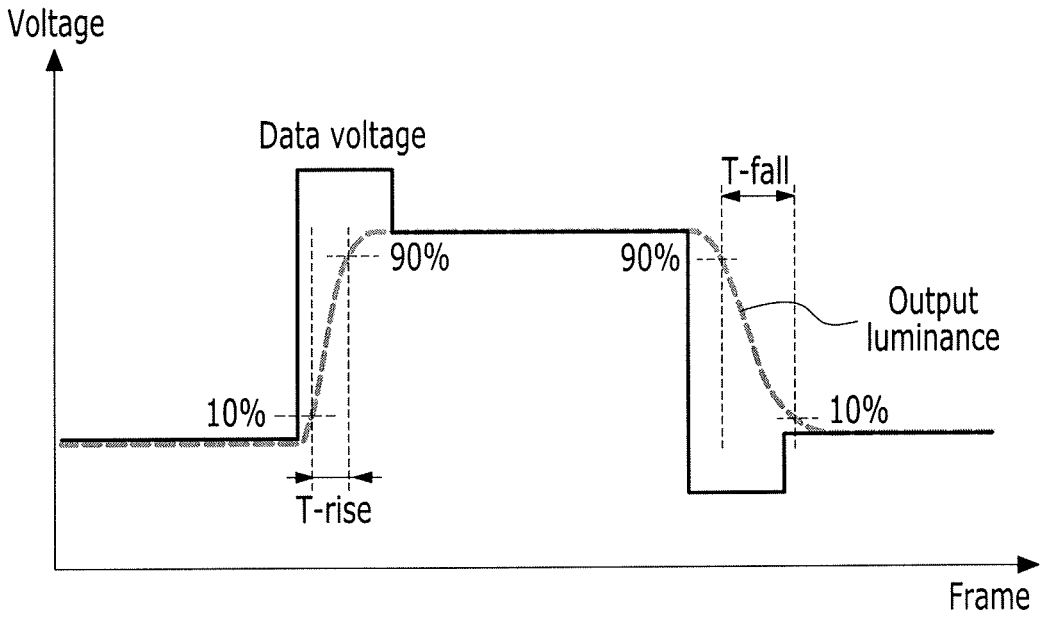
FIG. 8 is a graph showing a second DCC according to an exemplary embodiment of the present invention.

For example, the rising time T-rise may be shorter than the falling time T-fall, as shown in FIG. 8. When the case in which the rising time T-rise is shorter than the falling time T-fall is applied as the second DCC, the first DCC in which the rising time T-rise and the falling time T-fall are the same as each other may be made by matching the rising time T-rise to the falling time T-fall.

As described above, the first DCC is applied to the detection block including the moving pattern and the second DCC is applied to the detection block in which the moving pattern is not included and thus the flicker of the motion picture may be reduced and the response speed of the liquid crystal may be prevented from being deteriorated. This will be described below with reference to FIGS. 9 to 11.

Figure 9:
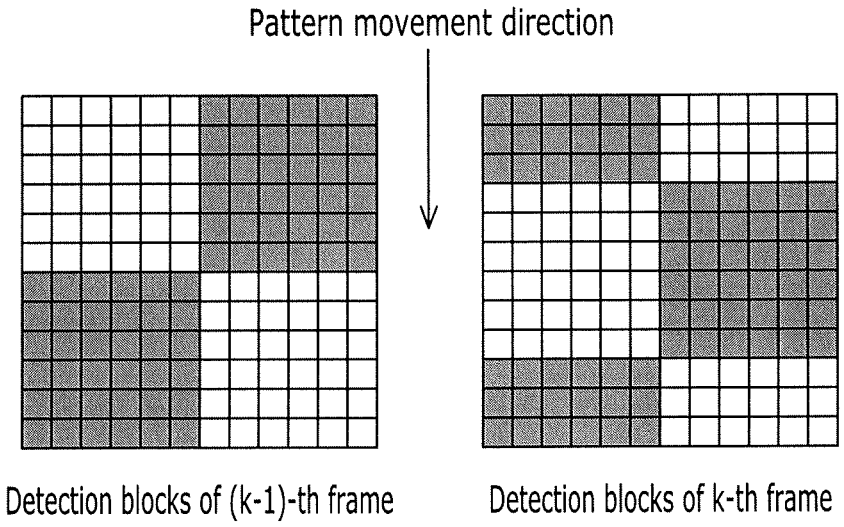
FIG. 9 is a diagram showing a moving pattern when a response time of a liquid crystal is adjusted by a data processor, according to an exemplary embodiment of the present invention.
Figure 10:
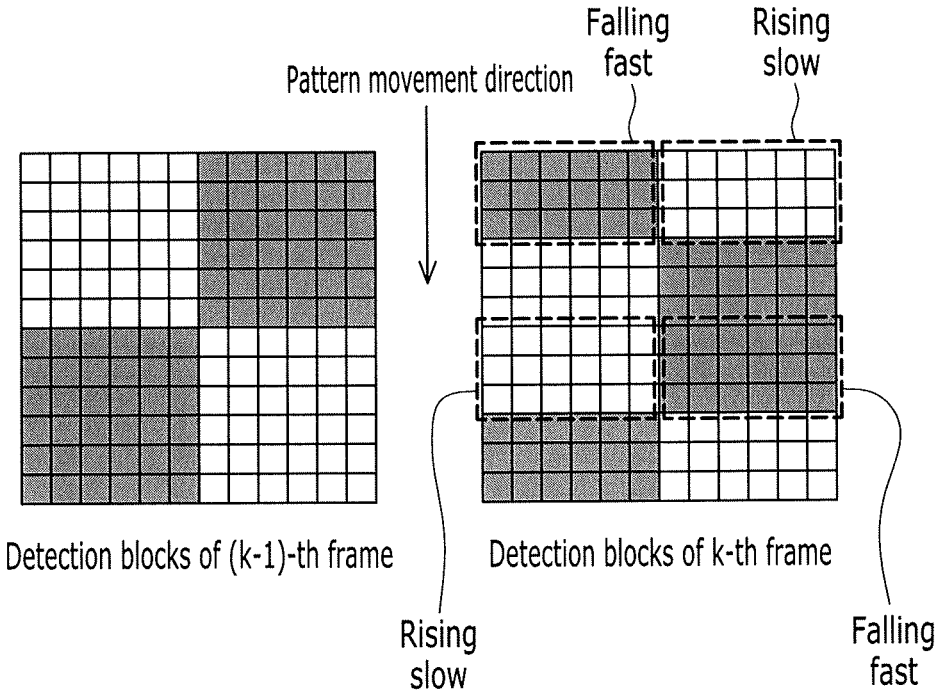
FIG. 10 is a diagram showing a moving pattern when a response time of a liquid crystal is not adjusted, according to an exemplary embodiment of the present invention.
Figure 11:
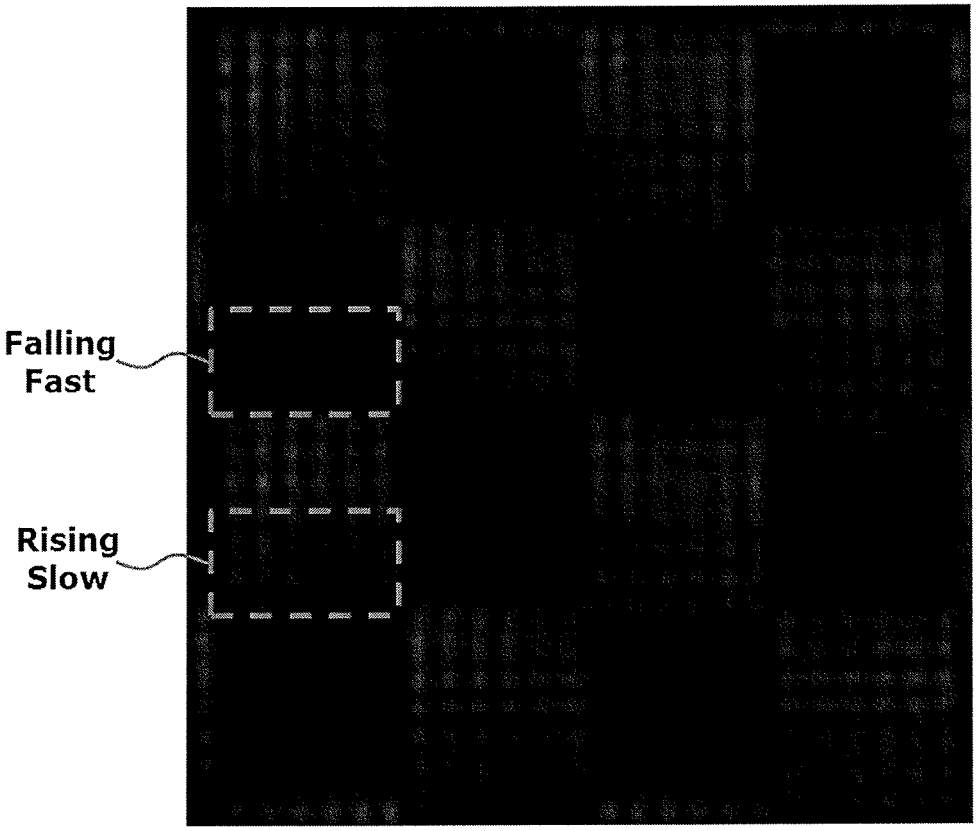
FIG. 11 is a diagram showing an example of measuring a moving pattern using a detection device when a response time of a liquid crystal is not adjusted by a data processor, according to an exemplary embodiment of the present invention.

FIG. 9 is a diagram showing a moving pattern when a response time of a liquid crystal is adjusted by a data processor, according to an exemplary embodiment of the present invention. FIG. 10 is a diagram showing a moving pattern when a response time of a liquid crystal is not adjusted by a data processor, according to an exemplary embodiment of the present invention. FIG. 11 is a diagram showing an example of measuring a moving pattern using a detection device when a response time of a liquid crystal is not adjusted by a data processor, according to an exemplary embodiment of the present invention.

FIG. 9 shows a case in which a plurality of detection blocks has a size of 12×12 and a lattice pattern having a size of 6×6 moves at a speed of 3 pixels per frame in a downward direction.

Referring to FIG. 9, a plurality of detection blocks is determined to include a moving pattern by a data processor 500, and when a first DCC is applied thereto, a rising time T-rise and a falling time T-fall are the same as each other in the corresponding detection blocks. Thus, a time (e.g., rising time T-rise) in which a low gray value in a region of a (k−1)-th frame is changed to a high gray value in the corresponding region of a k-th frame and a time (e.g., falling time T-fall) in which the high gray value in the region of the (k−1)-th frame is changed to the low gray value in the corresponding region of the k-th frame are the same as each other. Thus, when displaying the moving pattern, the flicker in which the luminance becomes lower by a difference between the rising time T-rise and the falling time T-fall may be reduced. For example, the flicker in which the luminance of the motion picture becomes lower may be reduced.

In addition, when the first DCC is not applied to the detection block including the moving pattern and the second DCC having different rising time T-rise and falling time T-fall is applied to the detection block including the moving pattern, the flicker I may occur by the difference between the rising time T-rise and the falling time T-fall, as shown in FIG. 10, and thus luminance of a region in which the flicker occurs may be lowered.

Referring to FIG. 10, when the rising time T-rise is longer than the falling time T-fall, the time (e.g., rising time T-rise) in which the low gray value in a region of the (k−1)-th frame is changed to the high gray value in the corresponding region of the k-th frame is longer than the time (e.g., falling time T-falling) in which the high gray value in the region of the (k−1)-th frame is changed to the low gray value in the corresponding region of the k-th frame. For example, a rising slow phenomenon in which a region to be display with the high gray value in the k-th frame becomes brighter relatively slowly may be generated, and a falling fast phenomenon in which a region to be display with the low gray value in the k-th frame becomes darker relatively quickly may be generated. Thus, the k-th frame generally has lower luminance compared to the (k−1)-th frame.

In a display device, when displaying the moving pattern by applying only the second DCC without applying the first DCC and measuring the moving pattern by using a detector, the rising slow and falling fast phenomena may be generated, as shown in FIG. 11.

In addition, the number of raw frames when the image is photographed and the number of display frames when the display device displays the image may be different from each other. In this case, a pull-down method of repeatedly displaying the raw frames according to a specific rule may be used. For example, when the image is photographed, the image is photographed at 24 frames per second and is displayed at 60 frames per second (e.g., 60 Hz) through the display device.

In this case, in the display device, when applying only the second DCC without applying the first DCC to the moving pattern, the rising slow and falling fast phenomena may be generated, and a moving pattern region may become relatively dark in the motion picture compared to the still image. For example, the moving pattern region may be a region in which the moving pattern is included.

Hereinafter, the flicker generated when the image is displayed using the full-down method will be described with reference to FIG. 12.

Figure 12:
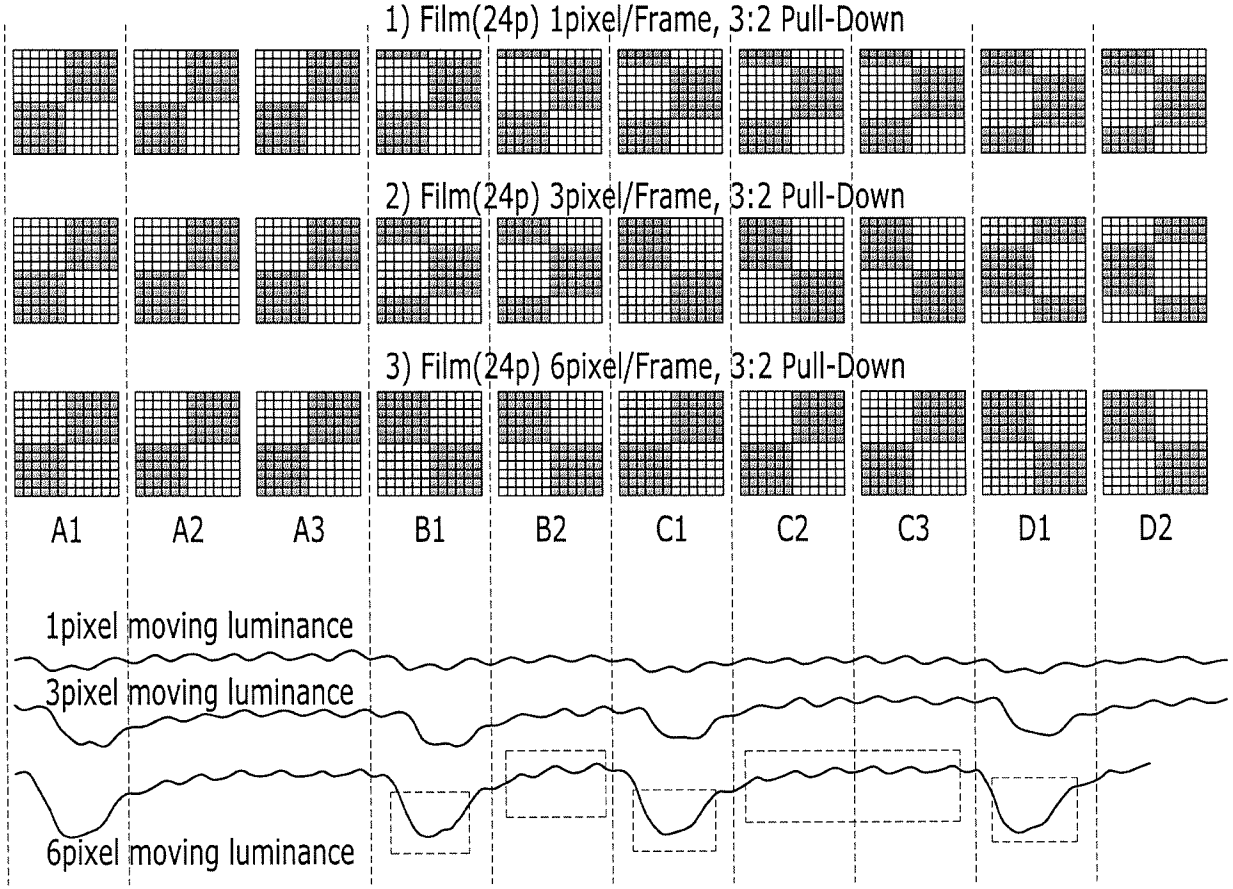
FIG. 12 is a diagram showing an example of detecting a flicker of a moving pattern when images photographed at 24 frames per second are displayed at 60 Hz using a 3:2 pull-down method in a display device.

FIG. 12 is a diagram showing an example of detecting the flicker of the moving pattern when the images photographed at 24 frames per second are displayed at 60 frames per second (e.g., 60 Hz) using a 3:2 full-down method in a display device.

Referring to FIG. 12, when a detection block in the photographed image has a size of 12×12, FIG. 12 shows a case A (e.g., 1 pixel moving) in which a lattice pattern having a size of 6×6 moves at a speed of 1 pixel per frame in a downward direction, a case B (e.g., 3 pixels moving) in which the lattice pattern having the size of 6×6 moves at a speed of 3 pixels per frame in the downward direction, and a case C (e.g., 6 pixels moving) in which the lattice pattern having the size of 6×6 displays moves at a speed of 6 pixels per frame in the downward direction.

For example, according to the 3:2 full-down method, the raw frame A of the photographed image is displayed as three display frames A1, A2, and A3, the raw frame B of the photographed image is displayed as two display frames B1 and B2, the raw frame C of the photographed image is displayed as three display frames C1, C2, and C3, and the raw frame D of the photographed image is displayed as two display frames D1 and D2.

The three display frames A1, A2, and A3 should be displayed in the same image. The two display frames B1 and B2 should be displayed in the same image. The three display frames C1, C2, and C3 should be displayed in the same image. The two display frames D1 and D2 should be displayed in the same image.

In this case, when applying only the second DCC without applying the first DCC to the moving pattern, the rising slow and falling fast phenomena may be generated in the display frames A1, B1, C1, and D1. When measuring the luminance of each of the display frames A1, B1, C1, and D1, the luminance may be relatively low in the display frames A1, B1, C1, and D1. For example, in the case C (e.g., 6 pixels moving), the luminance is lower than the luminance of the cases A (e.g., 1 pixel moving) and B (e.g., 3 pixels moving) in the display frames A1, B1, C1, and D1.

As described above, a flicker may occur in the display frames A1, B1, C1, and D1. An image repeatedly becomes bright and dark by the flicker and thus the luminance in the display frame A1, B1, C1, and D1 may be relatively low. The flicker may occur in accordance with a size and a moving speed of an image pattern. For example, when a moving pattern has a size of 3×3, if the moving pattern moves at speeds of e.g., 3, 9, 15 pixels per frame, the flicker may occur, but if the moving pattern moves at speeds of e.g., 6, 12, 18 pixels per frame, the flicker might not occur. When the moving pattern has a size of 6×6, if the moving pattern moves at speeds of 6, 18, . . . pixels per frame, the flicker may occur, but if the moving pattern moves at speeds of 12, 24, . . . pixels per frame, the flicker might not occur.

According to the exemplary embodiment of the present invention, when the data processor 500 applies the first DCC to the detection block including the moving pattern, the flicker might not occur regardless of the size and moving speed of the moving pattern by preventing the luminance from being lowered in the display frames A1, B1, C1, and D1.

Although the present invention has been described with reference to exemplary embodiments thereof, it will be understood that the present invention should not be limited to the disclosed embodiments, but, is intended to cover various modifications and equivalent arrangements included within the spirit and scope of the appended claims.

What is claimed is:

1. A display device, comprising:

a plurality of pixels;

a data driver configured to apply a first data voltage to a first data line of a plurality of data lines, wherein the first data line is connected to a first pixel of the plurality of pixels;

a signal controller configured to transfer an image data signal and a data control signal for controlling an operation of the data driver, wherein the image data signal includes a first image signal and a second image signal; and a data processor configured to detect a first region including a moving pattern in the first image signal, to apply a first dynamic capacitance control (DCC) to the first region, to apply a second DCC to a second region other than the moving pattern region, to generate the second image signal by combining the first region to which the first DCC is applied and the second region to which the second DCC is applied, and to transfer the second image signal to the signal controller, wherein during a first time period, the first data voltage is higher than a reference data voltage corresponding to a first luminance to be displayed by a first predetermined level, or during a second time period, the first data voltage is lower than the reference data voltage by a second predetermined level, and wherein a rising time and a falling time of luminance of the first pixel are the same as each other when the first DCC is applied, and the rising time and the falling time of the luminance of the first pixel are not controlled when the second DCC is applied.

2. The display device of claim 1, wherein the data processor includes:

a frame memory configured to store the first image signal in a frame unit;

a moving pattern detector configured to divide an image signal of a current frame into a plurality of current detection blocks, and an image signal of a previous frame stored in the frame memory into a plurality of previous detection blocks, respectively, to detect a detection block including the moving pattern among the plurality of current detection blocks, and to transfer the plurality of current detection blocks to a first DCC unit or a second DCC unit;

the first DCC unit configured to perform the first DCC on the plurality of current detection blocks transferred from the moving pattern detector; and the second DCC unit configured to perform the second DCC on the plurality of current detection blocks transferred from the moving pattern detector.

3. The display device of claim 2, wherein the data processor further includes a data buffer configured to hold the first image signal in the frame unit, and to transfer the held first image signal to the frame memory and the moving pattern detector.

4. The display device of claim 2, wherein the plurality of current detection blocks and the plurality of previous detection blocks have the same size.

5. The display device of claim 4, wherein the moving pattern detector is configured to determine whether a first difference between an average luminance of the plurality of current detection blocks and an average luminance of the plurality of previous detection blocks is smaller than a first reference value, and to transfer the plurality of current detection blocks to the second DCC unit when the first difference is larger than or equal to the first reference value.

6. The display device of claim 5, wherein the moving pattern detector is configured to determine whether a second difference between luminance of each pixel in the plurality of current detection blocks and luminance of each pixel in the previous detection blocks is larger than a second reference value when the first difference is smaller than the first reference value.

7. The display device of claim 6, wherein the moving pattern detector is configured to transfer the plurality of current detection blocks to the second DCC unit when the second difference is smaller than or equal to the second reference value.

8. The display device of claim 6, wherein, the moving pattern detector is configured to transfer the plurality of current detection blocks to the first DCC unit when the second difference is larger than the second reference value.

9. The display device of claim 1, wherein each of the plurality of pixels includes:

a pixel electrode to which a data voltage is applied;

a common electrode to which a common voltage is applied; and a liquid crystal layer provided between the pixel electrode and the common electrode.

10. The display device of claim 9, wherein the rising time is a time required to increase the luminance of the first pixel from 10% to 90% of an amount of the increased luminance.

11. The display device of claim 10, wherein, after the first time period of the rising time, the first data voltage is changed to the reference data voltage when the luminance of the first pixel is substantially equal to the first luminance to be displayed.

12. The display device of claim 9, wherein the falling time is a time required to decrease the luminance of the first pixel from 90% to 10% of an amount of the decreased luminance.

13. The display device of claim 12, wherein, after the second time period of the falling time, the first data voltage is changed to the reference voltage when the luminance of the first pixel is substantially equal to the first luminance to be displayed.

14. A method for driving a display device, comprising:

receiving first frame data;

receiving second frame data after the first frame has been received data;

dividing the received first frame data into a plurality of first detection blocks;

dividing the received second frame data into a plurality of second detection blocks;

detecting a detection block including a moving pattern among the plurality of second detection blocks;

applying a first dynamic capacitance control (DCC) to the detection block including the moving pattern; and applying a second DCC to a detection block from among the plurality of second detection blocks in which the moving pattern is not included, wherein a first data voltage applied to a first pixel in the display device is higher than a reference voltage corresponding to a first luminance to be displayed by a first predetermined level, or lower than the reference voltage by a second predetermined level, and wherein a rising time and a falling time of luminance of the first pixel are the same as each other when the first DCC is applied, and the rising time and the falling time of the luminance of the first pixel are not controlled when the second DCC is applied.

15. The method of claim 14, further comprising storing the first frame data in a frame unit.

16. The method of claim 14, wherein the plurality of first detection blocks and the plurality of second detection blocks have the same size.

17. The method of claim 14, wherein the detecting of the detection block including the moving pattern among the plurality of second detection blocks includes:

determining whether a first difference between an average luminance of the plurality of second detection blocks and an average luminance of the plurality of first detection blocks is smaller than a first reference value; and applying the second DCC to the plurality of second detection blocks when the first difference is larger than or equal to the first reference value.

18. The method of claim 17, wherein the detecting of the detection block including the moving pattern among the plurality of detection blocks further includes determining whether a second difference between luminance of each pixel in the plurality of second detection blocks and luminance of each pixel in the plurality of first detection blocks is larger than a second reference value when the first difference is smaller the first reference value.

19. The method of claim 18, wherein the detecting of the detection block including the moving pattern among the plurality of detection blocks further includes applying the second DCC when the second difference is equal to or smaller than the second reference value.

20. The method of claim 18, wherein the detecting of the detection block including the moving pattern among the plurality of detection blocks further includes applying the first DCC when the second difference is larger than the second reference value.

21. A data processor in a display device, comprising:

a frame memory configured to store a first image signal in a frame unit;

a moving pattern detector configured to divide an image signal of a current frame into a plurality of current detection blocks, to divide an image signal of a previous frame stored in the frame memory into a plurality of previous detection blocks, to detect a detection block including a moving pattern among the plurality of current detection blocks, and to transfer the plurality of current detection blocks to a first dynamic capacitance control (DCC) unit or a second DCC unit depending on whether the plurality of current detection blocks includes the moving pattern;

the first dynamic capacitance control (DCC) unit configured to perform a first DCC on the plurality of current detection blocks transferred from the moving pattern detector;

the second DCC unit configured to apply a second DCC on the plurality of current detection blocks transferred from the moving pattern detector; and a data output section configured to generate a second image signal by combining the output image signals from the first DCC unit and the second DCC unit.

* * * * *